US007192236B1

(12) United States Patent
Upmeyer

(10) Patent No.: US 7,192,236 B1
(45) Date of Patent: Mar. 20, 2007

(54) SHELF STACKING MACHINE

(75) Inventor: Ulrich Upmeyer, Borgholzhausen (DE)

(73) Assignee: Westfalia-WST-Systemtechnik GmbH & Co. KG, Borgholzhausen (DE)

( * ) Notice: Subject to any disclaimer, the term of this patent is extended or adjusted under 35 U.S.C. 154(b) by 0 days.

(21) Appl. No.: 09/914,773

(22) PCT Filed: Feb. 29, 2000

(86) PCT No.: PCT/EP00/01674

§ 371 (c)(1),
(2), (4) Date: Sep. 4, 2001

(87) PCT Pub. No.: WO00/51931

PCT Pub. Date: Sep. 8, 2000

(30) Foreign Application Priority Data

Mar. 2, 1999 (DE) ..... 299 03 671 U

(51) Int. Cl.
*B66F 9/07* (2006.01)

(52) U.S. Cl. ..... 414/273; 414/279; 414/280; 414/620; 414/911

(58) Field of Classification Search ..... 414/274, 414/279, 280, 281, 785, 911, 273, 620
See application file for complete search history.

(56) References Cited

U.S. PATENT DOCUMENTS

| | | | | |
|---|---|---|---|---|
| 2,643,781 | A | 6/1953 | Wise | |
| 2,645,372 | A * | 7/1953 | Broersma | 414/620 |
| 3,964,614 | A | 6/1976 | Welch | |
| 4,491,918 | A * | 1/1985 | Yuki et al. | 414/273 |
| 4,499,541 | A * | 2/1985 | Yuki et al. | 414/273 |
| 4,634,332 | A * | 1/1987 | Kamide et al. | 414/273 |
| 4,682,929 | A * | 7/1987 | Kataoka | 414/589 |
| 4,714,399 | A * | 12/1987 | Olson | 414/621 |
| 4,742,468 | A * | 5/1988 | Ohashi et al. | 701/50 |
| 4,974,520 | A * | 12/1990 | Dehne | 105/148 |
| 5,007,522 | A * | 4/1991 | Focke et al. | 198/468.8 |
| 5,046,914 | A * | 9/1991 | Holland et al. | 414/706 |
| 5,655,870 | A * | 8/1997 | Yasuhara et al. | 414/273 |
| 5,743,703 | A * | 4/1998 | Nakajima | 414/590 |
| 5,927,932 | A * | 7/1999 | Seaberg | 414/620 |
| 5,938,710 | A * | 8/1999 | Lanza et al. | 701/50 |
| 6,350,100 | B1 * | 2/2002 | Naruse et al. | 414/635 |

FOREIGN PATENT DOCUMENTS

EP 0 334 366 A2 9/1989

* cited by examiner

*Primary Examiner*—Thomas J. Brahan
(74) *Attorney, Agent, or Firm*—Browdy and Neimark, PLLC

(57) ABSTRACT

The invention relates to a shelf stacking machine for stocking and removing paper reels, especially in the printing industry. The shelf stacking machine can be driven in a lane with storage places at both sides. Said storage places receive paper reels which are stacked one on top of the other or behind each other in the direction of the lane. The shelf stacking machine is provided with a receptacle for a paper reel. Said receptacle is formed by a fork which can be height-adjustably pivoted around a horizontal axle. The fork is provided with measuring devices which detect the load of the received paper reel. The measuring devices supply the detected measured data via a control device to an actuator which is coupled to the fork movement-wise and which height-adjustably pivots the fork into the horizontal position according to the measured data. The actuator holds the fork in said horizontal position during paper reel transport.

14 Claims, 5 Drawing Sheets

SHELF STACKING MACHINE

REFERENCE TO RELATED APPLICATIONS

Figure 1:
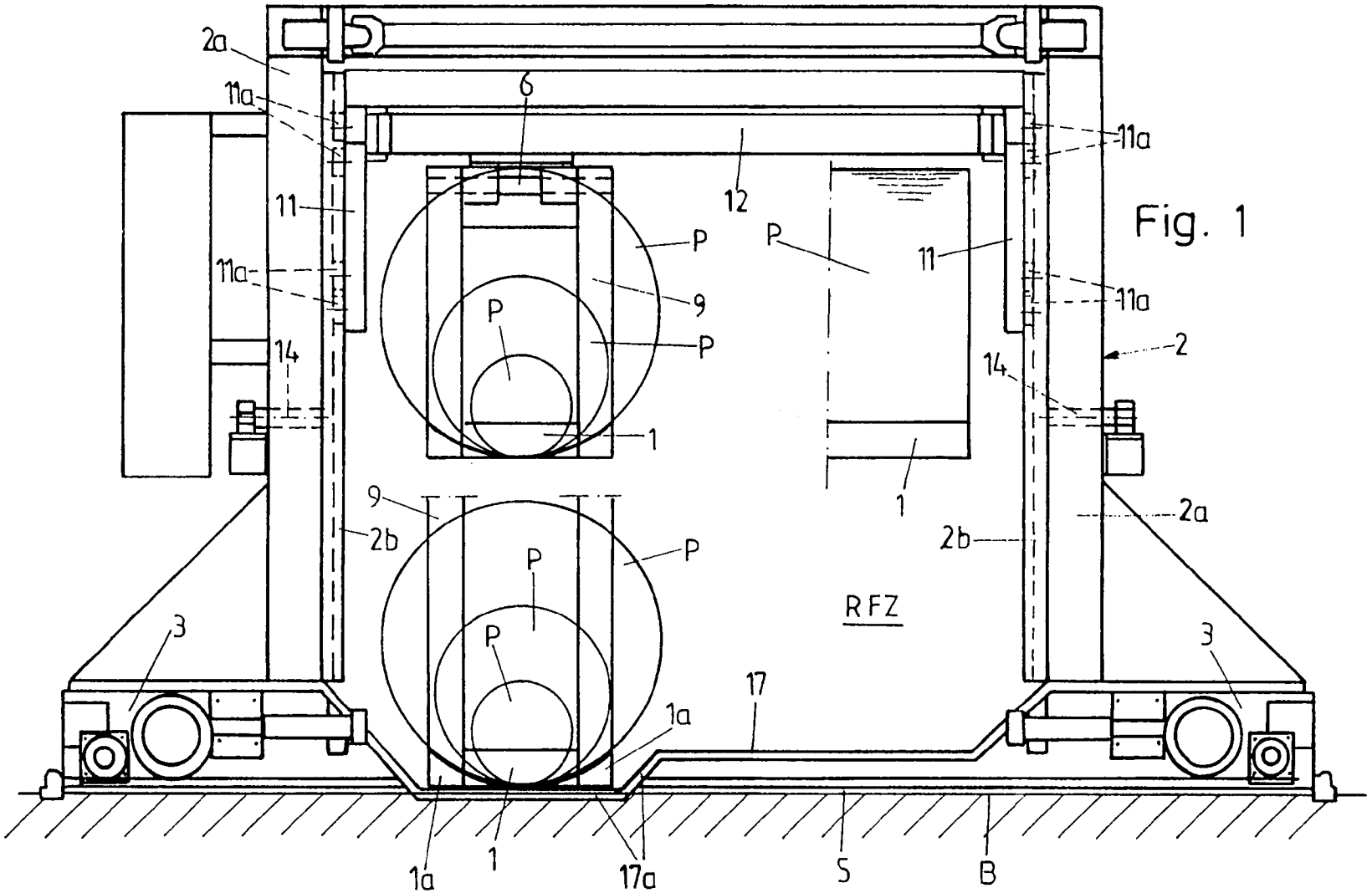

The present application is the national stage under 35 U.S.C. §371 of international application PCT/EP00/01674, filed 29 Feb. 2000 which designated the United States, and which application was not published in the English language.

The present invention is aimed at creating a shelf stacking machine for storing and retrieving paper reels in a cost-effective fashion, particularly in the printing industry (print shops), that uses an advantageously designed receptacle to accurately grasp paper reels of various diameters located both on the floor and in higher locations and transport them in a secure position.

This object is met according to the invention with the characterizing features of claim 1.

Moreover, it shall be possible to quickly drive the shelf stacking machine out of its operating aisle in a simple manner, when necessary.

This object is met with the characterizing features of claim 10.

The subclaims contain design features that represent advantageous and beneficial improvements of the presented solutions according to claim 1 and claim 10.

The inventive shelf stacking machine is equipped with a receptacle formed by a fork, which is brought into a horizontal position around a horizontal axis with the aid of measuring devices in accordance with the detected carrying load of the paper reel, i.e., the load of the paper reel that was picked up and could cause the fork to tilt downward is compensated by the measuring devices in such a way that they transmit their measuring data to an actuator, which then pivots the fork around the horizontal axis into the horizontal position.

The reel is thus picked up by the fork in a secure position for storing, retrieval and transport.

Moreover, the fork is designed so advantageously that it forms a flat receptacle and is, at the same time, adapted for greatly varying reel diameters, and this fork can also securely grasp paper reels lying on the floor as well as paper reels in higher locations.

Besides being vertically pivotable, the fork is rotatable on the shelf stacking machine crosswise to the driving direction of the shelf stacking machine for storing and retrieval purposes and in the driving direction with or without a reel, which is achieved by means of a rotating ring that receives the fork with its frame and is supported with the fork on a lift and drive unit of the shelf stacking machine; this lift and drive unit permits, on one hand, a to and fro movement of the fork towards the paper reel and away from the same, and on the other hand the vertical movement towards the given location of the paper reel to be picked up or deposited.

A further advantage of the invention lies in a transport vehicle that is firmly integrated into the shelf stacking machine or also coupled to the shelf stacking machine and cooperates with two coaxial pivoting pins of the shelf stacking machine and, on one hand, raises the shelf stacking machine off its drive rail and, on the other hand, swivels the shelf stacking machine around the horizontal pins into a tilted position so that it can be moved out of the rack aisle quickly when needed and without interference because of the tilted position.

This shelf stacking machine is designed particularly for storing and retrieving paper reels in print shops, however, it can ultimately also be used for storing and retrieving other goods.

Figure 2:
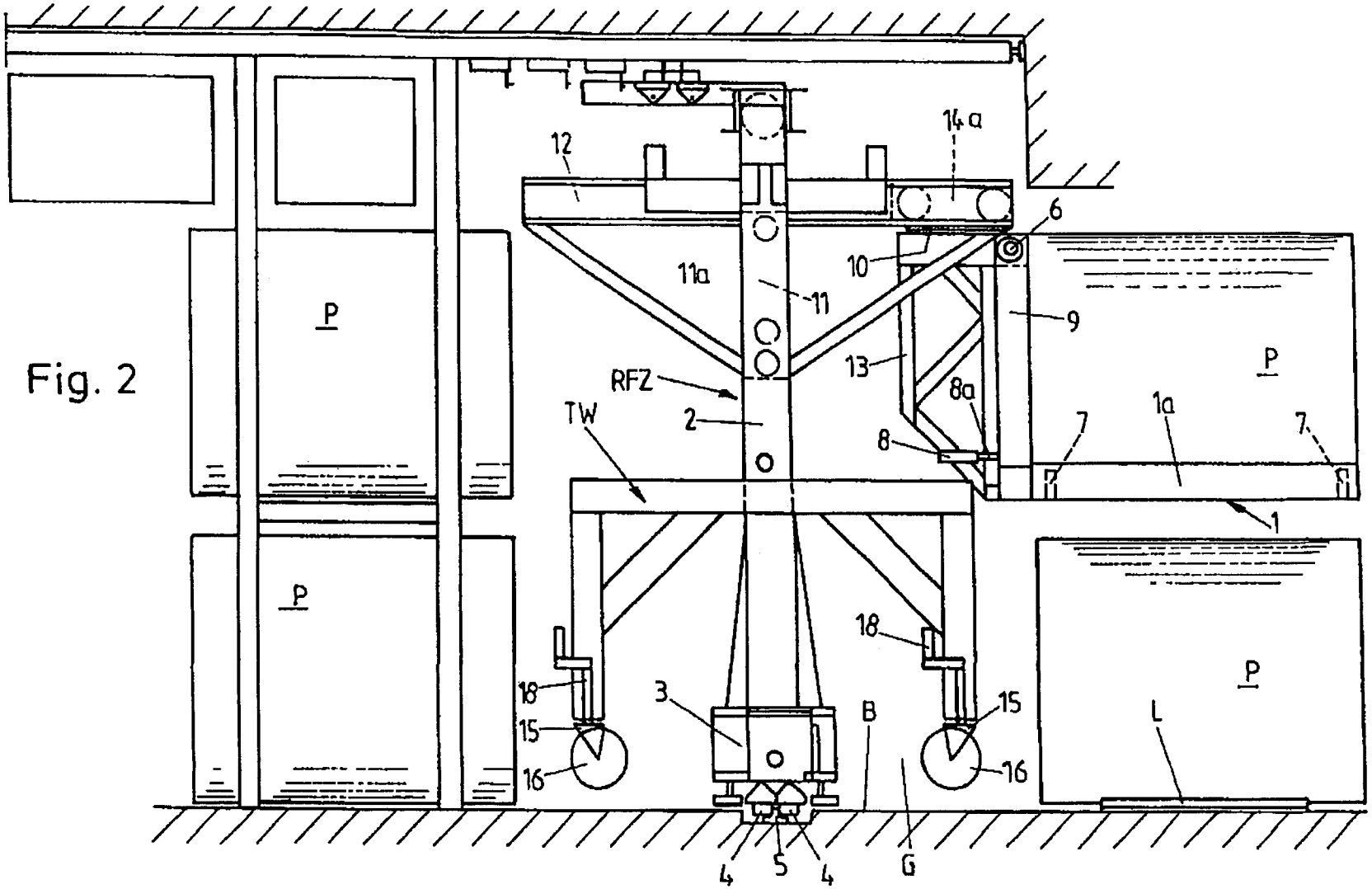
Figure 3:
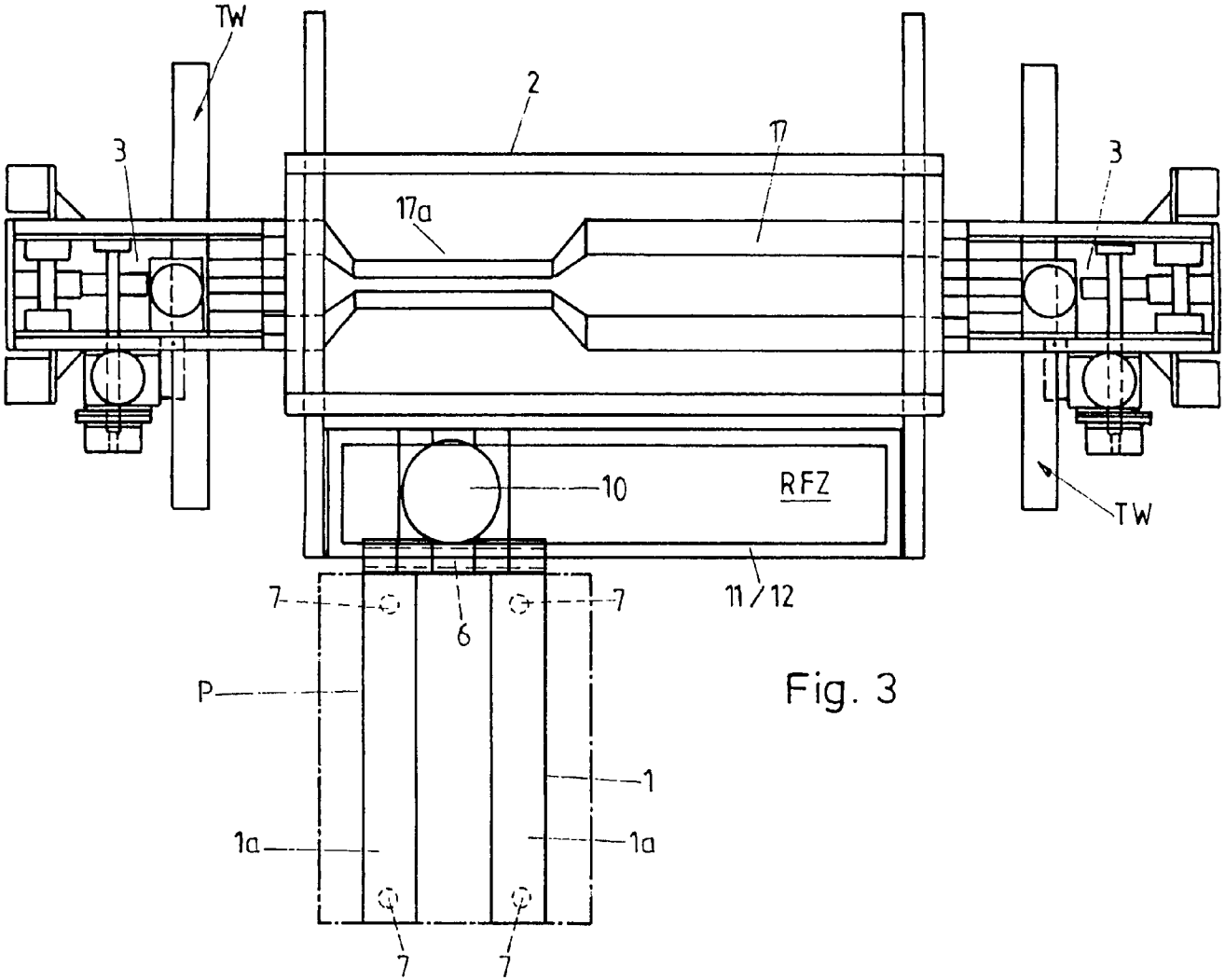
Figure 4:
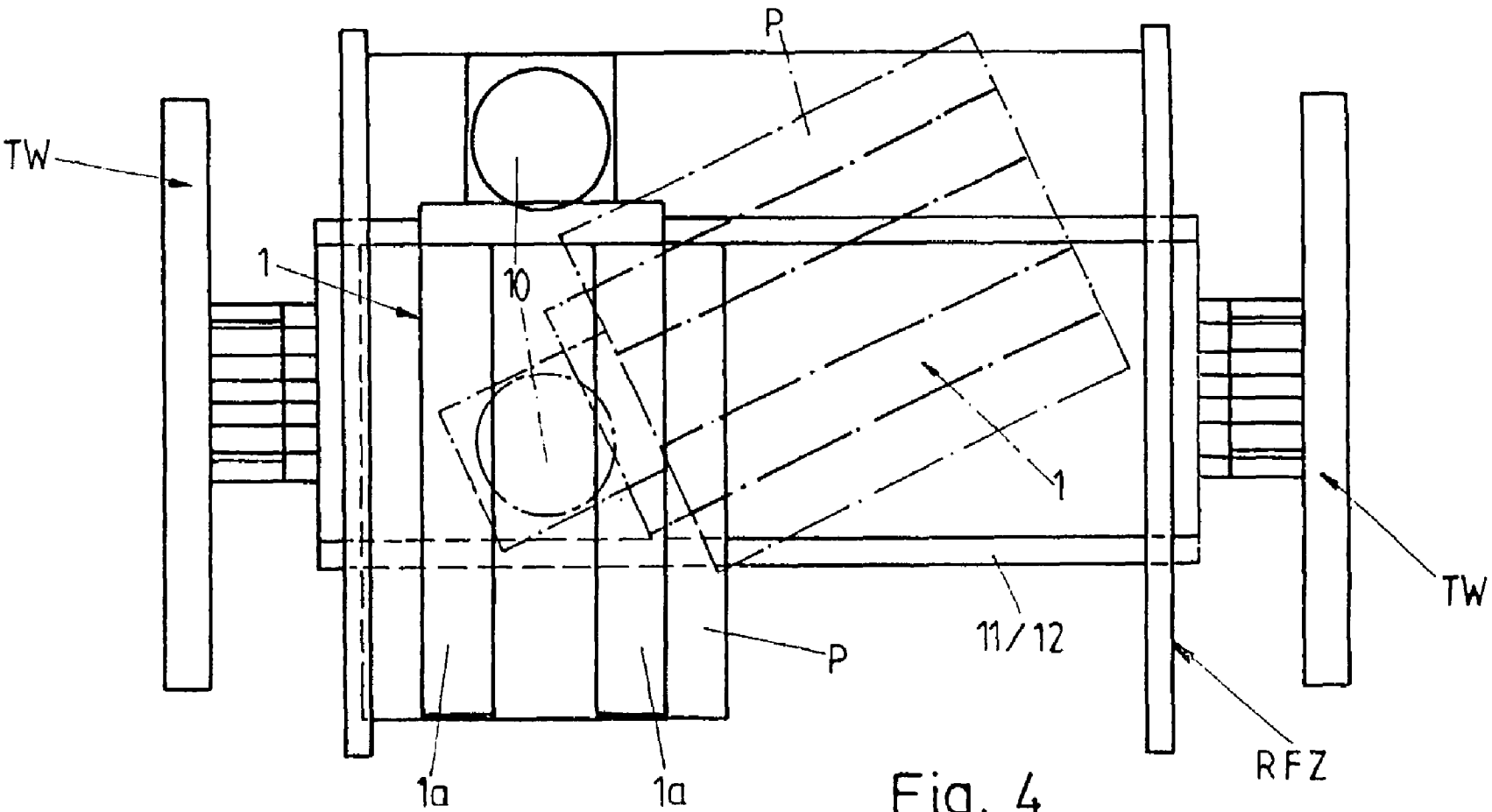
Figure 5:
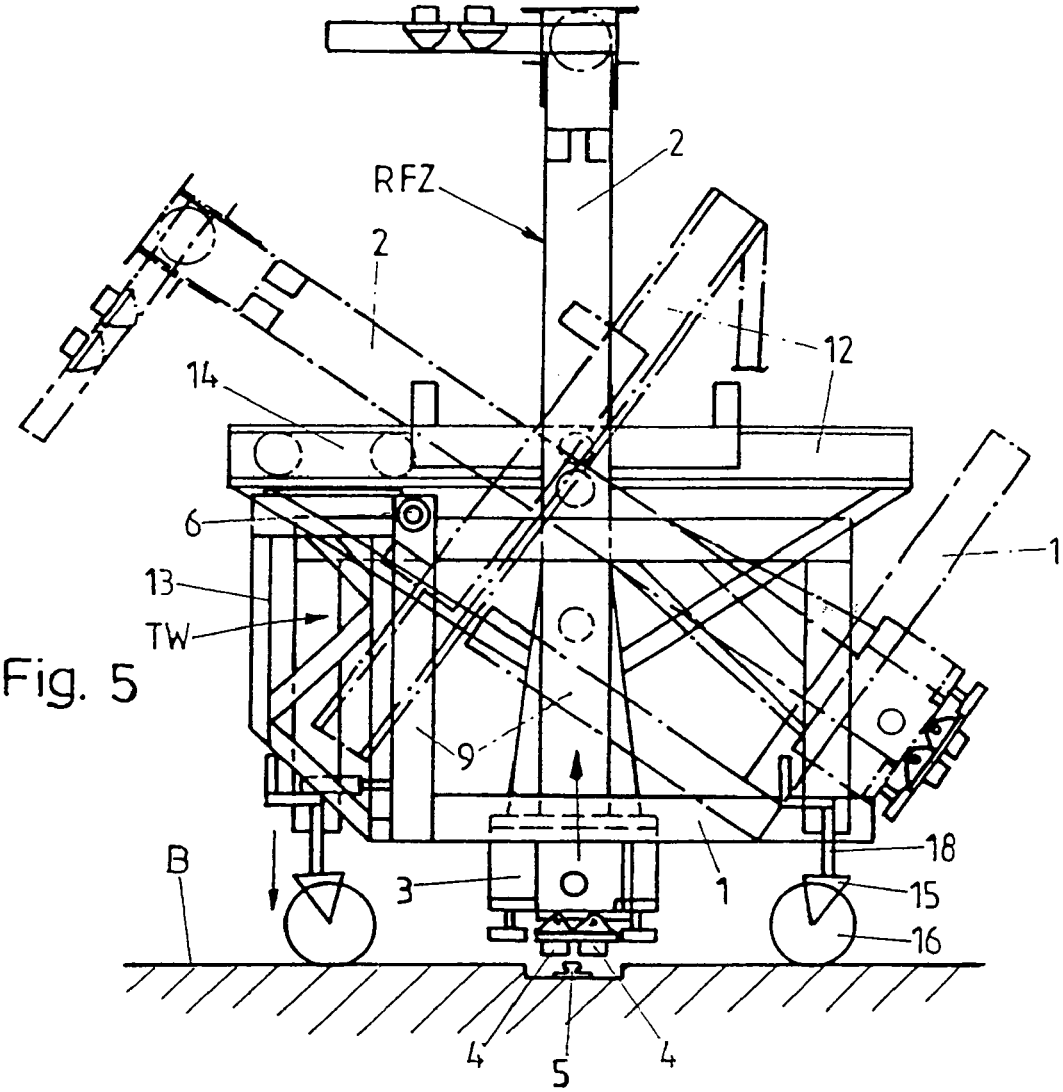
Figure 6:
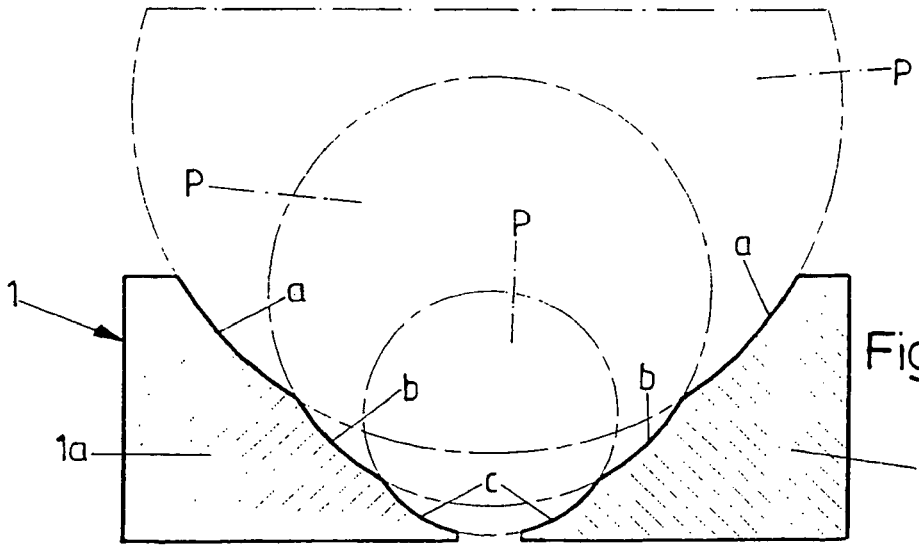

An embodiment of the invention is shown in the drawings and will be explained in more detail below. In the drawings:

FIG. 1 shows a side view of the shelf stacking machine with a fork-shaped receptacle for paper reels, FIG. 2 shows a front view of the shelf stacking machine incorporating a vertically adjustable and pivotable fork that can also be moved into and out of a rack compartment during pick-up of a paper reel and a transport vehicle, FIG. 3 shows a top view of the shelf stacking machine, FIG. 4 shows a top view of the shelf stacking machine with a fork pivoted into two positions by means of a horizontal rotating ring, FIG. 5 shows a front view of the shelf stacking machine raised by the transport vehicle and tilted around a horizontal axis to move the shelf stacking machine out of the rack aisle, FIG. 6 shows a front view of the fork with receptacle sections for paper reel diameters of various sizes.

The shelf stacking machine (RFZ) for storing and retrieving paper reels (P), particularly in the printing industry, is movable in an aisle (G) between storage positions on both sides that hold paper reels (P) stacked above one another and behind one another in the longitudinal direction of the aisle, and has a receptacle (1) for a paper reel (P).

The shelf stacking machine (RFZ) has a stand (2), preferably a U-shaped stand (2), which is supported with its two vertical posts (2*a*) formed by the U-legs on one motor driven moving device (3) per post. Each moving device has a support wheel, preferably made of steel, as well as a plastic coated drive wheel.

The moving devices (3) run with guide rollers (4) on and at a drive rail (5)—crane rail—that is fixed on/in the warehouse floor (B) or a pit.

Two paper reels (P) are preferably disposed above one another on both sides of the aisle (G) in such a way that one paper reel (P) lies on the warehouse floor (B) or on a low storage position (L) near the floor, and the second reel (P) lies above the former, at a distance, as shown in FIG. 2.

However, multiple reels (P) may also be stored above one another and rows of paper reels (P) may lie in the longitudinal direction of the aisle—the driving direction of the shelf stacking machine (RFZ).

The receptacle (1) is formed by a fork (1) that is vertically pivotable around a horizontal axis (6) and incorporates measuring devices (7) that detect the carrying load of the picked-up paper reel (P), which transmit the detected measuring data via a control means to an actuator (8) that is coupled to the fork (1) movement-wise and vertically pivots the fork (1) into the horizontal position in accordance with the measuring data and holds it in this horizontal position during transport of the paper reel.

Two ultrasound sensors are disposed as measuring devices (7) in each or in only one of the two fork members (1*a*) of the fork (1). The fork (1) has prism shaped and circular-arc shaped receiving sections (a, b, c) for various diameters of the paper reels (P), as shown in FIGS. 1 and 6.

The fork (1) is fixed on a vertical fork frame (9) that is supported with its upper end in the horizontal swivel axis (6) and actuated by the actuator (8) to pivot the fork vertically. The actuator may be driven either by an electric motor or also hydraulically.

The fork (1) is suspended with its fork frame (9) above a rotating ring (10) from a lift and drive unit formed by a lifting gear frame (11) and a drive frame (12). This results in the fork (1) being swiveled crosswise to the driving direction of the shelf stacking machine (RFZ) to store and retrieve reels and then swiveled back into the driving direction of the shelf stacking machine (RFZ) (FIG. 4) with or without a reel (P).

The fork frame (9) is supported with its pivot axis (6), which extends in the upper frame end, on a fork framework (13); this fork framework (13) is fixed with its upper end on the rotating ring (10) and the rotating ring (10) is held movable on the drive frame (12) by means of a moving device (14*a*) for storing and retrieving reels. The actuator (8), which also acts onto the fork frame (9) at a lifting element (8*a*), is fixed on the fork framework (13) in the height region of the fork (1).

The drive frame (12) is in contact with the lifting gear frame (11) on both sides, and the lifting gear frame (11) is co-supported in guides (2*b*) on the posts (2*a*) of the stand (2) of the shelf stacking machine (RFZ) in a manner so that it can be adjusted vertically; the lift and drive unit (11, 12) thus extends between the posts (2*a*) and can be moved within the stand (2) in the vertical direction from the lowest to the highest paper reel (P).

The shelf stacking machine (2) with the lift and drive units (11, 12) and fork (1) is coupled or can be coupled to a transport vehicle (TW)—a driveable transport frame—that moves the shelf stacking machine (RFZ) out of the rack aisle (6), i.e., the transport vehicle (TW) is a mobile component that is firmly disposed at the stand (2) or can be fastened to the stand (2).

A horizontal pin (14)—a pivot axis—extends in and on both of the posts (2*a*) of the shelf stacking machine stand (2), and both pins (14) are located coaxially opposite one another; these pins (14) are grasped by the transport vehicle (TW) for the tilting (pivoting of the shelf stacking machine stand (2) from the vertical position into an inclined position), as shown in FIG. 5.

The transport vehicle (TW) is designed portal-like and has vertically adjustable lifting elements (15) with support rollers (16) to raise the shelf stacking machine (RFZ) out of its drive rail (5) in the warehouse floor or pit.

The vertical adjustment of the lifting elements (15) with the steerable support rollers (16) may take place mechanically (crank handle 18), electric motor driven, or hydraulically.

Situated between the posts (2*a*) of the stand (2) of the shelf stacking machine (RFZ) is a cross connection (17) with a clearance channel (17*a*) that is pulled down to the warehouse floor (B) to pick up a paper reel (P) located on the floor by means of the fork (1) (FIGS. 1 and 3).

The clearance channel (17*a*) that is pulled down very low is located in the lifting region of the fork (1) so that the same can be lowered close to the warehouse floor (B) to hook under the* on the warehouse floor (B) or a low storage position (L)—an adapter—with its lift-drive unit (11, 12).

*Translator's note: The German-language sentence on which this translation is based appears to be missing a noun or is otherwise incomplete.

In a further embodiment, the receptacle (1) is formed by a mandrel, preferably a telescoping mandrel, that hooks into (is pushed in and out of) the reel core for storing and retrieving the paper reels (P).

With this shelf stacking machine (RFZ) it is possible to pick up paper reels (P) situated on very low receptacle adapters (L)—storage places—also from the warehouse floor (B).

The shelf stacking machine (RFZ) moves towards the center of the pickup or depositing position of the paper reels (P) by means of a positioning system, lowers the receptacle fork (1) to below the reel pickup region by means of a lifting unit (11, 12), and moves the receptacle fork (1) underneath the paper reel (P) to be picked up, i.e., into the storage compartment (FIG. 2).

The fork (1) is raised and takes the reel (P) from the adapter. During this lifting process the horizontal position of the fork (1) is ensured by means of an ultrasound measuring system (7) in combination with an actuator (8) that can adjust the fork frame (9) around the pivot axis (6).

Afterwards the fork (1) moves with the reel (P) back into the shelf stacking machine (RFZ) and is swiveled so that is parallel with the drive rail (5), the shelf stacking machine (RFZ) moves to the transfer position predetermined by the control means and transfers the reel (P). These movement sequences take place in parallel with the driving movements of the shelf stacking machine (RFZ)* obtain optimal cycle times.

*Translator's note: The German-language sentence on which this translation is based appears to be missing a preposition or is otherwise incomplete.

To be able to quickly remove the shelf stacking machine (RFZ) from the rack aisle (G), a mobile transport vehicle (TW) may be connected to the shelf stacking machine (RFZ) that raises the shelf stacking machine (RFZ) out of the drive rail (5) and can tilt it into a slanted position around the axis pins (14) if required, and pull it out of the rack aisle (G) to the side (FIG. 5).

The fork (1) is thus swiveled via the rotating ring (10) into a position orthogonal to the driving direction of the shelf stacking machine (RFZ) for storing and retrieving reels, and into a reel transport and idle position parallel to the driving direction of the shelf stacking machine (RFZ), and moved vertically by means of the lift-drive unit (11, 12) to the storage and retrieval position, and crosswise and lengthwise to the driving direction of the shelf stacking machine (RFZ) into the storing and retrieval position and for transporting reels or idle movement.

With a special safety control, more than one shelf stacking machine (RFZ) may be operated in the same rack aisle.

What is claimed is:

1. A shelf stacking machine for storing and retrieving paper reels, which is movable in an aisle between storage positions on both sides that hold paper reels stored above one another and spaced apart in the longitudinal direction of the aisle, and has a fork for carrying paper reels, characterized in that said fork (1) is vertically pivotable around a horizontal axis (6) and comprises at least one measuring device (7) that detects the carrying load of a picked-up paper reel (P), said machine further comprising an actuator (8) coupled to said at least one measuring device to receive detected measuring data indicating the load carried by said fork, said actuator (8) being coupled to said fork (1) to vertically pivot said fork (1) into a horizontal position in accordance with the measuring data and to hold said fork in this horizontal position during transport of the paper reel.

2. A shelf stacking machine according to claim 1, characterized in that said fork is composed of two fork pieces (1*a*) and two ultrasound sensors are disposed as measuring devices (7) in at least one of the two fork pieces (1*a*) of the fork (1).

3. A shelf stacking machine according to claim 1, characterized in that the fork (1) is provided with prism shaped or circular-arc shaped fork sections (a, b, c) for various diameters of the paper reels (P).

4. A shelf stacking machine according to claim 1, characterized in that the fork (1) is fixed on a vertical fork frame (9) that is supported with its upper end in the horizontal axis (6) and actuated by the actuator (8) to pivot the fork vertically.

5. A shelf stacking machine according to claim 4, characterized in that the fork (1) is suspended with a rotating ring (10) from a lift and drive unit formed by a lifting gear frame (11) and a drive frame (12), the fork frame (9) is supported at the horizontal axis (6) on a fork framework (13), said fork framework (13) is fixed at its upper end on the rotating ring (10), and the rotating ring (10) is moveable with a moving device (14*a*) on the drive frame (12) for storing and removing reels.

6. A shelf stacking machine according to claim 5, characterized in that the actuator (8), which acts onto the fork frame (9) with a lifting element (8*a*) that can be moved to and fro, is fixed on the fork framework (13).

7. A shelf stacking machine according to claim 1, characterized in that the fork (1) is suspended with a rotating ring (10) from a lift and drive unit formed by a lifting gear frame (11) and a drive frame (12).

8. A shelf stacking machine according to claim 7, characterized in that the drive frame (12) is held on the lifting gear frame (11) at both ends and the lifting gear frame (11) is supported vertically adjustable with rollers (11*a*) on a stand (2) of the shelf stacking machine.

9. A shelf stacking machine according to claim 8, characterized in that the stand (2) of the shelf stacking machine is formed U-shaped and includes two vertical posts (2*a*), that the stand (2) with said vertical posts stands on motor driven moving devices (3), that said lifting gear frame (11) and said drive frame (12) lie between said posts (2*a*) of said stand (2), and that the lifting gear frame (11) is guided with said rollers (11*a*) vertically adjustable on said posts (2*a*).

10. A shelf stacking machine according to claim 9, characterized in that said stand (2) is or can be coupled to a transport vehicle (TW) that moves the shelf stacking machine out of the aisle (G).

11. A shelf stacking machine according to claim 10, characterized in that one horizontal axis pin (14) is disposed in each of said two posts (2*a*) of said shelf stacking machine stand (2), that both pins (14) are situated coaxially opposite one another and are grasped by the transport vehicle (TW) for pivoting of said stand from a vertical position into an inclined position.

12. A shelf stacking machine according to claim 10, characterized in that the shelf stacking machine is movable on a drive rail, the transport vehicle (TW) incorporates vertically adjustable lifting elements (15) with support rollers (16) to raise the shelf stacking machine out of the drive rail (5) on a warehouse floor or in a pit.

13. A shelf stacking machine according to claim 12, characterized in that the lifting elements (15) of the transport vehicle (TW) are vertically adjustable by means of support rollers, either mechanically, electric motor driven, or hydraulically.

14. A shelf stacking machine according to claim 12, characterized in that a cross connection (17) is disposed between the posts (20) of the stand (2) of the shelf stacking machine with a clearance channel (17*a*) that is pulled down to the warehouse floor (B) for picking up a paper reel (P) from the floor with the fork (1).

* * * * *